US009305520B2

(12) United States Patent
Higashi et al.

(10) Patent No.: US 9,305,520 B2
(45) Date of Patent: Apr. 5, 2016

(54) IMAGE DISPLAY APPARATUS, METHOD OF DRIVING IMAGE DISPLAY APPARATUS, GRAYSCALE CONVERSION PROGRAM, AND GRAYSCALE CONVERSION APPARATUS

(71) Applicant: Japan Display Inc., Tokyo (JP)

(72) Inventors: Amane Higashi, Aichi (JP); Tsutomu Harada, Kanagawa (JP); Yasuyuki Teranishi, Aichi (JP); Masaya Tamaki, Kanagawa (JP)

(73) Assignee: Japan Display Inc., Tokyo (JP)

( * ) Notice: Subject to any disclaimer, the term of this patent is extended or adjusted under 35 U.S.C. 154(b) by 487 days.

(21) Appl. No.: 13/740,683

(22) Filed: Jan. 14, 2013

(65) Prior Publication Data

US 2013/0222439 A1 Aug. 29, 2013

(30) Foreign Application Priority Data

Feb. 27, 2012 (JP) ..... 2012-039705

(51) Int. Cl.
*G09G 3/20* (2006.01)
*G09G 5/10* (2006.01)

(52) U.S. Cl.
CPC ..... *G09G 5/10* (2013.01); *G09G 3/2059* (2013.01); *G09G 2340/0428* (2013.01)

(58) Field of Classification Search
CPC ..... G09G 5/10; G09G 3/2059; G09G 3/2007–3/2081; G09G 3/3607; G09G 3/2066; H04N 1/4052; H04N 1/6058; H04N 1/32251; H04N 1/32256
See application file for complete search history.

(56) References Cited

U.S. PATENT DOCUMENTS

| | | | | |
|---|---|---|---|---|
| 6,965,389 | B1 * | 11/2005 | Masuji et al. | 345/690 |
| 7,310,105 | B2 * | 12/2007 | Yamada | 345/690 |
| 7,315,313 | B2 * | 1/2008 | Nose et al. | 345/690 |
| 2004/0109088 | A1 * | 6/2004 | Lee et al. | 348/607 |
| 2005/0156951 | A1 * | 7/2005 | Okuzawa | 345/691 |
| 2006/0290989 | A1 * | 12/2006 | Kobayashi | 358/3.03 |

OTHER PUBLICATIONS

Floyd et al., "An Adaptive Algorithm for Spatial Greyscale," Journal of the Society for Information Display, vol. 17, No. 2, 1976. (3 pages).

* cited by examiner

*Primary Examiner* — William Boddie
*Assistant Examiner* — Andrew Schnirel
(74) *Attorney, Agent, or Firm* — K&L Gates LLP

(57) ABSTRACT

An image display apparatus includes: a grayscale conversion device configured to perform grayscale conversion processing on input data to output data; and a display device configured to operate in accordance with the output data to display an image by pixels arranged in a two-dimensional matrix state, wherein the grayscale conversion device is configured to perform first error diffusion processing for converting $N_0$-grayscale input data into $N_1$-grayscale data ($2<N_1<N_0$), to perform second error diffusion processing for converting data having a predetermined grayscale or less into lower grayscale data having N2 grayscales ($1<N_2<N_1$), to perform third error diffusion processing for converting data having the predetermined grayscale or more into higher grayscale data having N3 grayscales ($1<N_3<N_1$), and to combine the lower grayscale data and the higher grayscale data to generate $N_4$-grayscale output data ($1<N_4<N_1$).

6 Claims, 14 Drawing Sheets

FIG. 3

[S100]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 0 | 16 | 32 | 48 | 64 | 80 | 96 | 112 | 128 | 144 | 160 | 176 | 192 | 208 | 224 | 255 |
| 2 | 0 | 16 | 32 | 48 | 64 | 80 | 96 | 112 | 128 | 144 | 160 | 176 | 192 | 208 | 224 | 255 |
| 3 | 0 | 16 | 32 | 48 | 64 | 80 | 96 | 112 | 128 | 144 | 160 | 176 | 192 | 208 | 224 | 255 |
| 4 | 0 | 16 | 32 | 48 | 64 | 80 | 96 | 112 | 128 | 144 | 160 | 176 | 192 | 208 | 224 | 255 |
| 5 | 0 | 16 | 32 | 48 | 64 | 80 | 96 | 112 | 128 | 144 | 160 | 176 | 192 | 208 | 224 | 255 |
| 6 | 0 | 16 | 32 | 48 | 64 | 80 | 96 | 112 | 128 | 144 | 160 | 176 | 192 | 208 | 224 | 255 |
| 7 | 0 | 16 | 32 | 48 | 64 | 80 | 96 | 112 | 128 | 144 | 160 | 176 | 192 | 208 | 224 | 255 |
| 8 | 0 | 16 | 32 | 48 | 64 | 80 | 96 | 112 | 128 | 144 | 160 | 176 | 192 | 208 | 224 | 255 |
| 9 | 0 | 16 | 32 | 48 | 64 | 80 | 96 | 112 | 128 | 144 | 160 | 176 | 192 | 208 | 224 | 255 |
| 10 | 0 | 16 | 32 | 48 | 64 | 80 | 96 | 112 | 128 | 144 | 160 | 176 | 192 | 208 | 224 | 255 |
| 11 | 0 | 16 | 32 | 48 | 64 | 80 | 96 | 112 | 128 | 144 | 160 | 176 | 192 | 208 | 224 | 255 |
| 12 | 0 | 16 | 32 | 48 | 64 | 80 | 96 | 112 | 128 | 144 | 160 | 176 | 192 | 208 | 224 | 255 |
| 13 | 0 | 16 | 32 | 48 | 64 | 80 | 96 | 112 | 128 | 144 | 160 | 176 | 192 | 208 | 224 | 255 |
| 14 | 0 | 16 | 32 | 48 | 64 | 80 | 96 | 112 | 128 | 144 | 160 | 176 | 192 | 208 | 224 | 255 |
| 15 | 0 | 16 | 32 | 48 | 64 | 80 | 96 | 112 | 128 | 144 | 160 | 176 | 192 | 208 | 224 | 255 |
| 16 | 0 | 16 | 32 | 48 | 64 | 80 | 96 | 112 | 128 | 144 | 160 | 176 | 192 | 208 | 224 | 255 |

FIG. 4A
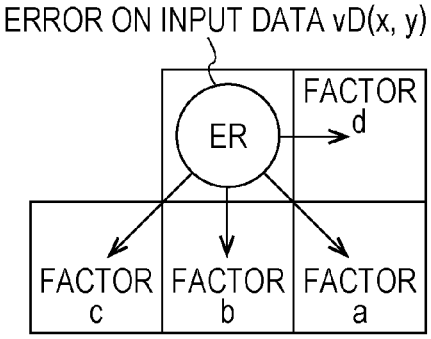
FIG. 4B
| | | |
|---|---|---|
| | curr | 7/16 |
| 3/16 | 5/16 | 1/16 |
FIG. 4C
| | | |
|---|---|---|
| | curr | 1/2 |
| 1/4 | 1/4 | 0 |
FIG. 4D
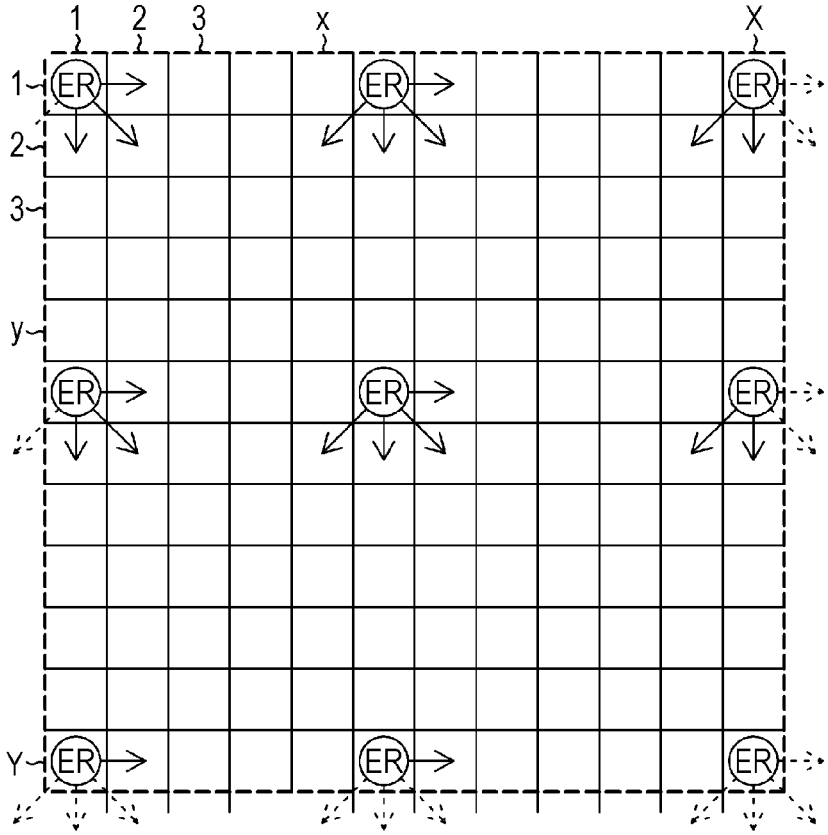

FIG. 5

[S110]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 0 | 0 | 20 | 20 | 60 | 83 | 83 | 83 | 123 | 150 | 150 | 176 | 176 | 202 | 202 | 255 |
| 2 | 0 | 20 | 20 | 60 | 60 | 83 | 83 | 123 | 123 | 150 | 168 | 176 | 202 | 202 | 202 | 255 |
| 3 | 0 | 20 | 20 | 60 | 60 | 83 | 83 | 123 | 123 | 150 | 150 | 176 | 176 | 202 | 255 | 255 |
| 4 | 0 | 20 | 20 | 60 | 60 | 83 | 83 | 123 | 123 | 150 | 168 | 176 | 202 | 202 | 202 | 255 |
| 5 | 0 | 20 | 20 | 60 | 60 | 83 | 83 | 123 | 123 | 150 | 150 | 176 | 202 | 202 | 202 | 255 |
| 6 | 0 | 20 | 20 | 60 | 60 | 83 | 83 | 123 | 123 | 150 | 168 | 176 | 176 | 202 | 255 | 255 |
| 7 | 0 | 20 | 20 | 60 | 60 | 83 | 83 | 123 | 123 | 150 | 150 | 176 | 202 | 202 | 202 | 255 |
| 8 | 0 | 0 | 20 | 60 | 60 | 83 | 83 | 123 | 123 | 150 | 168 | 176 | 202 | 202 | 202 | 255 |
| 9 | 0 | 20 | 20 | 60 | 60 | 83 | 83 | 123 | 123 | 150 | 150 | 176 | 202 | 202 | 255 | 255 |
| 10 | 0 | 20 | 20 | 60 | 60 | 83 | 83 | 123 | 123 | 150 | 168 | 176 | 176 | 202 | 202 | 255 |
| 11 | 0 | 20 | 20 | 60 | 60 | 83 | 83 | 123 | 123 | 150 | 150 | 176 | 202 | 202 | 202 | 255 |
| 12 | 0 | 20 | 20 | 60 | 60 | 83 | 83 | 123 | 123 | 150 | 168 | 176 | 202 | 202 | 255 | 255 |
| 13 | 0 | 20 | 20 | 20 | 83 | 83 | 83 | 123 | 123 | 150 | 150 | 176 | 202 | 202 | 202 | 255 |
| 14 | 0 | 0 | 20 | 60 | 60 | 83 | 83 | 123 | 123 | 150 | 168 | 176 | 176 | 202 | 202 | 255 |
| 15 | 0 | 20 | 20 | 60 | 60 | 83 | 83 | 123 | 123 | 150 | 150 | 176 | 202 | 202 | 255 | 255 |
| 16 | 0 | 20 | 20 | 60 | 60 | 83 | 83 | 123 | 123 | 150 | 168 | 176 | 202 | 202 | 202 | 255 |

FIG. 6

[S120A]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 0 | 0 | 20 | 20 | 60 | 83 | 83 | 83 | 123 | 150 | 150 | N/A | N/A | N/A | N/A | N/A |
| 2 | 0 | 20 | 20 | 60 | 60 | 83 | 83 | 123 | 123 | 150 | N/A | N/A | N/A | N/A | N/A | N/A |
| 3 | 0 | 20 | 20 | 60 | 60 | 83 | 83 | 123 | 123 | 150 | 150 | N/A | N/A | N/A | N/A | N/A |
| 4 | 0 | 20 | 20 | 60 | 60 | 83 | 83 | 123 | 123 | 150 | N/A | N/A | N/A | N/A | N/A | N/A |
| 5 | 0 | 20 | 20 | 60 | 60 | 83 | 83 | 123 | 123 | 150 | 150 | N/A | N/A | N/A | N/A | N/A |
| 6 | 0 | 20 | 20 | 60 | 60 | 83 | 83 | 123 | 123 | 150 | N/A | N/A | N/A | N/A | N/A | N/A |
| 7 | 0 | 20 | 20 | 60 | 60 | 83 | 83 | 123 | 123 | 150 | 150 | N/A | N/A | N/A | N/A | N/A |
| 8 | 0 | 0 | 20 | 60 | 60 | 83 | 83 | 123 | 123 | 150 | N/A | N/A | N/A | N/A | N/A | N/A |
| 9 | 0 | 20 | 20 | 60 | 60 | 83 | 83 | 123 | 123 | 150 | 150 | N/A | N/A | N/A | N/A | N/A |
| 10 | 0 | 20 | 20 | 60 | 60 | 83 | 83 | 123 | 123 | 150 | N/A | N/A | N/A | N/A | N/A | N/A |
| 11 | 0 | 20 | 20 | 60 | 60 | 83 | 83 | 123 | 123 | 150 | 150 | N/A | N/A | N/A | N/A | N/A |
| 12 | 0 | 20 | 20 | 60 | 60 | 83 | 83 | 123 | 123 | 150 | N/A | N/A | N/A | N/A | N/A | N/A |
| 13 | 0 | 20 | 20 | 20 | 83 | 83 | 83 | 123 | 123 | 150 | 150 | N/A | N/A | N/A | N/A | N/A |
| 14 | 0 | 0 | 20 | 60 | 60 | 83 | 83 | 123 | 123 | 150 | N/A | N/A | N/A | N/A | N/A | N/A |
| 15 | 0 | 20 | 20 | 60 | 60 | 83 | 83 | 123 | 123 | 150 | 150 | N/A | N/A | N/A | N/A | N/A |
| 16 | 0 | 20 | 20 | 60 | 60 | 83 | 83 | 123 | 123 | 150 | N/A | N/A | N/A | N/A | N/A | N/A |

FIG. 7

[S130A]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 0 | 0 | 0 | 0 | 0 | 0 | 0 | 0 | 155 | 155 | 0 | N/A | N/A | N/A | N/A | N/A |
| 2 | 0 | 0 | 0 | 0 | 0 | 155 | 155 | 155 | 155 | 155 | N/A | N/A | N/A | N/A | N/A | N/A |
| 3 | 0 | 0 | 0 | 0 | 155 | 0 | 155 | 0 | 155 | 155 | 155 | N/A | N/A | N/A | N/A | N/A |
| 4 | 0 | 0 | 0 | 155 | 0 | 155 | 0 | 155 | 155 | 155 | N/A | N/A | N/A | N/A | N/A | N/A |
| 5 | 0 | 0 | 0 | 0 | 0 | 155 | 0 | 155 | 155 | 155 | 0 | N/A | N/A | N/A | N/A | N/A |
| 6 | 0 | 0 | 0 | 155 | 0 | 155 | 155 | 155 | 0 | 155 | N/A | N/A | N/A | N/A | N/A | N/A |
| 7 | 0 | 0 | 0 | 0 | 155 | 0 | 0 | 155 | 155 | 155 | 155 | N/A | N/A | N/A | N/A | N/A |
| 8 | 0 | 0 | 0 | 0 | 155 | 0 | 155 | 155 | 155 | 155 | N/A | N/A | N/A | N/A | N/A | N/A |
| 9 | 0 | 0 | 0 | 155 | 0 | 155 | 0 | 155 | 0 | 155 | 155 | N/A | N/A | N/A | N/A | N/A |
| 10 | 0 | 0 | 0 | 0 | 0 | 155 | 0 | 155 | 155 | 155 | N/A | N/A | N/A | N/A | N/A | N/A |
| 11 | 0 | 0 | 0 | 155 | 0 | 155 | 155 | 155 | 155 | 155 | 155 | N/A | N/A | N/A | N/A | N/A |
| 12 | 0 | 0 | 0 | 0 | 155 | 0 | 0 | 155 | 0 | 155 | N/A | N/A | N/A | N/A | N/A | N/A |
| 13 | 0 | 0 | 0 | 0 | 155 | 0 | 155 | 155 | 155 | 155 | 155 | N/A | N/A | N/A | N/A | N/A |
| 14 | 0 | 0 | 0 | 0 | 155 | 0 | 155 | 155 | 0 | 155 | N/A | N/A | N/A | N/A | N/A | N/A |
| 15 | 0 | 0 | 0 | 155 | 0 | 155 | 0 | 155 | 155 | 155 | 155 | N/A | N/A | N/A | N/A | N/A |
| 16 | 0 | 0 | 0 | 0 | 0 | 155 | 0 | 155 | 155 | 155 | N/A | N/A | N/A | N/A | N/A | N/A |

FIG. 8

[S120B]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | N/A | N/A | N/A | N/A | N/A | N/A | N/A | N/A | N/A | 150 | 150 | 176 | 176 | 202 | 202 | 255 |
| 2 | N/A | N/A | N/A | N/A | N/A | N/A | N/A | N/A | N/A | 150 | 168 | 176 | 202 | 202 | 202 | 255 |
| 3 | N/A | N/A | N/A | N/A | N/A | N/A | N/A | N/A | N/A | 150 | 150 | 176 | 176 | 202 | 255 | 255 |
| 4 | N/A | N/A | N/A | N/A | N/A | N/A | N/A | N/A | N/A | 150 | 168 | 176 | 202 | 202 | 202 | 255 |
| 5 | N/A | N/A | N/A | N/A | N/A | N/A | N/A | N/A | N/A | 150 | 150 | 176 | 202 | 202 | 202 | 255 |
| 6 | N/A | N/A | N/A | N/A | N/A | N/A | N/A | N/A | N/A | 150 | 168 | 176 | 176 | 202 | 255 | 255 |
| 7 | N/A | N/A | N/A | N/A | N/A | N/A | N/A | N/A | N/A | 150 | 150 | 176 | 202 | 202 | 202 | 255 |
| 8 | N/A | N/A | N/A | N/A | N/A | N/A | N/A | N/A | N/A | 150 | 168 | 176 | 202 | 202 | 202 | 255 |
| 9 | N/A | N/A | N/A | N/A | N/A | N/A | N/A | N/A | N/A | 150 | 150 | 176 | 202 | 202 | 255 | 255 |
| 10 | N/A | N/A | N/A | N/A | N/A | N/A | N/A | N/A | N/A | 150 | 168 | 176 | 176 | 202 | 202 | 255 |
| 11 | N/A | N/A | N/A | N/A | N/A | N/A | N/A | N/A | N/A | 150 | 150 | 176 | 202 | 202 | 202 | 255 |
| 12 | N/A | N/A | N/A | N/A | N/A | N/A | N/A | N/A | N/A | 150 | 168 | 176 | 202 | 202 | 255 | 255 |
| 13 | N/A | N/A | N/A | N/A | N/A | N/A | N/A | N/A | N/A | 150 | 150 | 176 | 202 | 202 | 202 | 255 |
| 14 | N/A | N/A | N/A | N/A | N/A | N/A | N/A | N/A | N/A | 150 | 168 | 176 | 176 | 202 | 202 | 255 |
| 15 | N/A | N/A | N/A | N/A | N/A | N/A | N/A | N/A | N/A | 150 | 150 | 176 | 202 | 202 | 255 | 255 |
| 16 | N/A | N/A | N/A | N/A | N/A | N/A | N/A | N/A | N/A | 150 | 168 | 176 | 202 | 202 | 202 | 255 |

FIG. 9

[S130B]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | N/A | N/A | N/A | N/A | N/A | N/A | N/A | N/A | N/A | 0 | 212 | 155 | 155 | 212 | 155 | 255 |
| 2 | N/A | N/A | N/A | N/A | N/A | N/A | N/A | N/A | N/A | 155 | 155 | 155 | 212 | 212 | 212 | 255 |
| 3 | N/A | N/A | N/A | N/A | N/A | N/A | N/A | N/A | N/A | 155 | 155 | 212 | 155 | 212 | 255 | 255 |
| 4 | N/A | N/A | N/A | N/A | N/A | N/A | N/A | N/A | N/A | 155 | 155 | 155 | 212 | 212 | 212 | 255 |
| 5 | N/A | N/A | N/A | N/A | N/A | N/A | N/A | N/A | N/A | 155 | 155 | 155 | 212 | 212 | 155 | 255 |
| 6 | N/A | N/A | N/A | N/A | N/A | N/A | N/A | N/A | N/A | 0 | 212 | 155 | 155 | 212 | 255 | 255 |
| 7 | N/A | N/A | N/A | N/A | N/A | N/A | N/A | N/A | N/A | 155 | 155 | 212 | 212 | 212 | 212 | 255 |
| 8 | N/A | N/A | N/A | N/A | N/A | N/A | N/A | N/A | N/A | 155 | 155 | 155 | 212 | 212 | 212 | 255 |
| 9 | N/A | N/A | N/A | N/A | N/A | N/A | N/A | N/A | N/A | 155 | 155 | 155 | 212 | 212 | 255 | 255 |
| 10 | N/A | N/A | N/A | N/A | N/A | N/A | N/A | N/A | N/A | 155 | 155 | 212 | 155 | 212 | 155 | 255 |
| 11 | N/A | N/A | N/A | N/A | N/A | N/A | N/A | N/A | N/A | 155 | 155 | 155 | 212 | 212 | 212 | 255 |
| 12 | N/A | N/A | N/A | N/A | N/A | N/A | N/A | N/A | N/A | 0 | 212 | 155 | 212 | 212 | 255 | 255 |
| 13 | N/A | N/A | N/A | N/A | N/A | N/A | N/A | N/A | N/A | 155 | 155 | 212 | 212 | 155 | 212 | 255 |
| 14 | N/A | N/A | N/A | N/A | N/A | N/A | N/A | N/A | N/A | 155 | 155 | 155 | 155 | 212 | 212 | 255 |
| 15 | N/A | N/A | N/A | N/A | N/A | N/A | N/A | N/A | N/A | 155 | 155 | 155 | 212 | 212 | 255 | 255 |
| 16 | N/A | N/A | N/A | N/A | N/A | N/A | N/A | N/A | N/A | 155 | 155 | 212 | 212 | 212 | 212 | 255 |

FIG. 10

[S140]

| Y \ X | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 0 | 0 | 0 | 0 | 0 | 0 | 0 | 0 | 155 | 155 | 212 | 155 | 155 | 212 | 155 | 255 |
| 2 | 0 | 0 | 0 | 0 | 0 | 155 | 155 | 155 | 155 | 155 | 155 | 155 | 212 | 212 | 212 | 255 |
| 3 | 0 | 0 | 0 | 0 | 155 | 0 | 155 | 0 | 155 | 155 | 155 | 212 | 155 | 212 | 255 | 255 |
| 4 | 0 | 0 | 0 | 155 | 0 | 155 | 0 | 155 | 155 | 155 | 155 | 155 | 212 | 212 | 212 | 255 |
| 5 | 0 | 0 | 0 | 0 | 0 | 155 | 0 | 155 | 155 | 155 | 155 | 155 | 212 | 212 | 155 | 255 |
| 6 | 0 | 0 | 0 | 155 | 0 | 155 | 155 | 155 | 0 | 155 | 212 | 155 | 155 | 212 | 255 | 255 |
| 7 | 0 | 0 | 0 | 0 | 155 | 0 | 0 | 155 | 155 | 155 | 155 | 212 | 212 | 212 | 212 | 255 |
| 8 | 0 | 0 | 0 | 0 | 155 | 0 | 155 | 155 | 155 | 155 | 155 | 155 | 212 | 212 | 212 | 255 |
| 9 | 0 | 0 | 0 | 155 | 0 | 155 | 0 | 155 | 0 | 155 | 155 | 155 | 212 | 212 | 255 | 255 |
| 10 | 0 | 0 | 0 | 0 | 0 | 155 | 0 | 155 | 155 | 155 | 155 | 212 | 155 | 212 | 155 | 255 |
| 11 | 0 | 0 | 0 | 155 | 0 | 155 | 155 | 155 | 155 | 155 | 155 | 155 | 212 | 212 | 212 | 255 |
| 12 | 0 | 0 | 0 | 0 | 155 | 0 | 0 | 155 | 0 | 155 | 212 | 155 | 212 | 212 | 255 | 255 |
| 13 | 0 | 0 | 0 | 0 | 155 | 0 | 155 | 155 | 155 | 155 | 155 | 212 | 212 | 155 | 212 | 255 |
| 14 | 0 | 0 | 0 | 0 | 155 | 0 | 155 | 155 | 0 | 155 | 155 | 155 | 155 | 212 | 212 | 255 |
| 15 | 0 | 0 | 0 | 155 | 0 | 155 | 0 | 155 | 155 | 155 | 155 | 155 | 212 | 212 | 255 | 255 |
| 16 | 0 | 0 | 0 | 0 | 0 | 155 | 0 | 155 | 155 | 155 | 155 | 212 | 212 | 212 | 212 | 255 |

FIG. 13A

| | | | | |
|---|---|---|---|---|
| | | curr | 7/48 | 5/48 |
| 3/48 | 5/48 | 7/48 | 5/48 | 3/48 |
| 1/48 | 3/48 | 5/48 | 3/48 | 1/48 |

FIG. 13B

| | | | | |
|---|---|---|---|---|
| | | curr | 8/42 | 4/42 |
| 2/42 | 4/42 | 8/42 | 4/42 | 2/42 |
| 1/42 | 2/42 | 4/42 | 2/42 | 1/42 |

FIG. 13C

| | | | | |
|---|---|---|---|---|
| | | curr | 4/16 | 2/16 |
| 1/16 | 2/16 | 4/16 | 2/16 | 1/16 |

IMAGE DISPLAY APPARATUS, METHOD OF DRIVING IMAGE DISPLAY APPARATUS, GRAYSCALE CONVERSION PROGRAM, AND GRAYSCALE CONVERSION APPARATUS

CROSS REFERENCES TO RELATED APPLICATIONS

The present application claims priority to Japanese Priority Patent Application JP 2012-039705 filed in the Japan Patent Office on Feb. 27, 2012, the entire content of which is hereby incorporated by reference.

BACKGROUND

The present disclosure relates to an image display apparatus for displaying an image on a display device, such as a liquid-crystal display panel, etc. Also, the present disclosure relates to a method of driving an image display apparatus, a grayscale conversion program, and a grayscale conversion apparatus.

For example, for a display device of a mobile electronic device, such as a mobile telephone or a mobile information terminal, or a display device of a personal computer or a television receiver, etc., a liquid-crystal display panel of a monochrome display or a color display, an electroluminescence display panel using electroluminescence of an inorganic material or an organic material, or a plasma display panel, etc., is used.

In the case where grayscale display ability of display device pixels is low, to put it another way, in the case where the number of grayscales of pixels is small, contour lines occur in an image, and thus image quality is deteriorated. In such a case, it is noted that image quality is improved using an error diffusion method.

In an error diffusion method, errors that occurred at the time of converting multivalued image data into binary image data, for example, (that is to say, differences between multivalued image data and binary image data) are "diffused" into a plurality of adjacent pixels with weighting factors (refer to R. W. Floyd and L. Steinberg, An adaptive algorithm for spatial grayscale, Journal of the Society for Information Display vol. 17, no. 2 pp 75-77, 1976). For example, by a typical Floyd-Steinberg method among error diffusion methods, as illustrated in FIGS. 4A and 4B, errors are diffused into a pixel located immediately after a current pixel and three pixels located in a first line lower than the current pixel. By the error diffusion method, it is possible to minimize errors that occurred between original multivalued image and, for example, binary halftone image in an averaged manner, and thus to generate a halftone image having an excellent image quality.

SUMMARY

An error diffusion method is a practical method that involves a small calculation load. However, for examples, for an image having gradation, there are cases where grayscale discontinuity becomes conspicuous, and display quality is deteriorated.

Accordingly, it is desirable to provide an image display apparatus capable of reducing grayscale discontinuity, a method of driving an image display apparatus, a grayscale conversion program, and a grayscale conversion apparatus.

According to an embodiment of the present disclosure, there is provided an image display apparatus including: a grayscale conversion device configured to perform grayscale conversion processing on input data and to output grayscale-converted output data; and a display device configured to operate in accordance with the output data from the grayscale conversion device and to display an image by pixels arranged in a two-dimensional matrix state, wherein the grayscale conversion device is configured to perform first error diffusion processing for converting $N_0$-grayscale input data into $N_1$-grayscale data (note that $N_0$ and $N_1$ are integers that satisfy $2<N_1<N_0$), next, to perform second error diffusion processing for converting data having a predetermined grayscale or less out of the $N_1$-grayscale data into lower grayscale data having N2 grayscales (note that $N_2$ is an integer that satisfies $1<N_2<N_1$), to perform third error diffusion processing for converting data having the predetermined grayscale or more out of the $N_1$-grayscale data into higher grayscale data having N3 grayscales (note that $N_3$ is an integer that satisfies $1<N_3<N_1$), and then to combine the lower grayscale data and the higher grayscale data to generate $N_4$-grayscale output data (note that $N_4$ is an integer that satisfies $1<N_4<N_1$).

According to another embodiment of the present disclosure, there is provided a method of driving an image display apparatus including a grayscale conversion device configured to perform grayscale conversion processing on input data and to output grayscale-converted output data, and a display device configured to operate in accordance with the output data from the grayscale conversion device and to display an image by pixels arranged in a two-dimensional matrix state, the method causes the grayscale conversion device to perform processing including: performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$); and performing third error diffusion processing for converting data having the predetermined grayscale or more out of the $N_1$-grayscale data into higher grayscale data having N3 grayscales (note that $N_3$ is an integer that satisfies $1<N_3<N_1$), and then combining the lower grayscale data and the higher grayscale data to generate $N_4$-grayscale output data (note that $N_4$ is an integer that satisfies $1<N_4<N_1$).

According to another embodiment of the present disclosure, there is provided a grayscale conversion program executed on a grayscale conversion device configured to perform grayscale conversion processing on input data and to output grayscale-converted output data, the grayscale conversion program performs processing including: performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$) and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

According to another embodiment of the present disclosure, there is provided a grayscale conversion apparatus including: a grayscale conversion device configured to perform grayscale conversion processing on input data and to output grayscale-converted output data, the grayscale conversion processing including: performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$); and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

By an image display apparatus according to the present disclosure, the grayscale conversion processing on input data is performed in combination of a result of second error diffusion processing and a result of third error diffusion processing on the data that have been subjected to first error diffusion processing. To put it in another way, error diffusion processing is performed for a plurality of times with different conditions, and thereby grayscale conversion processing is performed. Accordingly, grayscale discontinuity is reduced when processing is performed on an image having gentle gradation.

Additional features and advantages are described herein, and will be apparent from the following Detailed Description and the figures.

BRIEF DESCRIPTION OF THE FIGURES

FIG. 3 is a table for explaining input data values in step [S100] illustrated in FIG. 2;

FIG. 4A is a schematic plan view for explaining factors in error diffusion;

FIG. 4B is a diagram illustrating weighting factor values in the case of a Floyd Steinberg type;

FIG. 4C is a diagram illustrating weighting factor values in the case of a Sierra Filter lite type;

FIG. 4D is a schematic plan view for explaining error diffusion operation;

FIG. 5 is a table for explaining grayscale-converted data values in step [S100] illustrated in FIG. 2;

FIG. 6 is a table for explaining low grayscale data values extracted in step [S120A] illustrated in FIG. 2;

FIG. 7 is a table for explaining grayscale-converted data values in step [S130A] illustrated in FIG. 2;

FIG. 8 is a table for explaining high grayscale data values extracted in step [S120B] illustrated in FIG. 2;

FIG. 9 is a table for explaining grayscale-converted data values in step [S130B] illustrated in FIG. 2;

FIG. 10 is a table for explaining output data values generated in step [S140] illustrated in FIG. 2;

FIGS. 13A to 13C are diagrams illustrating examples of the other weighting factors of error diffusion.

DETAILED DESCRIPTION

Figure 1:
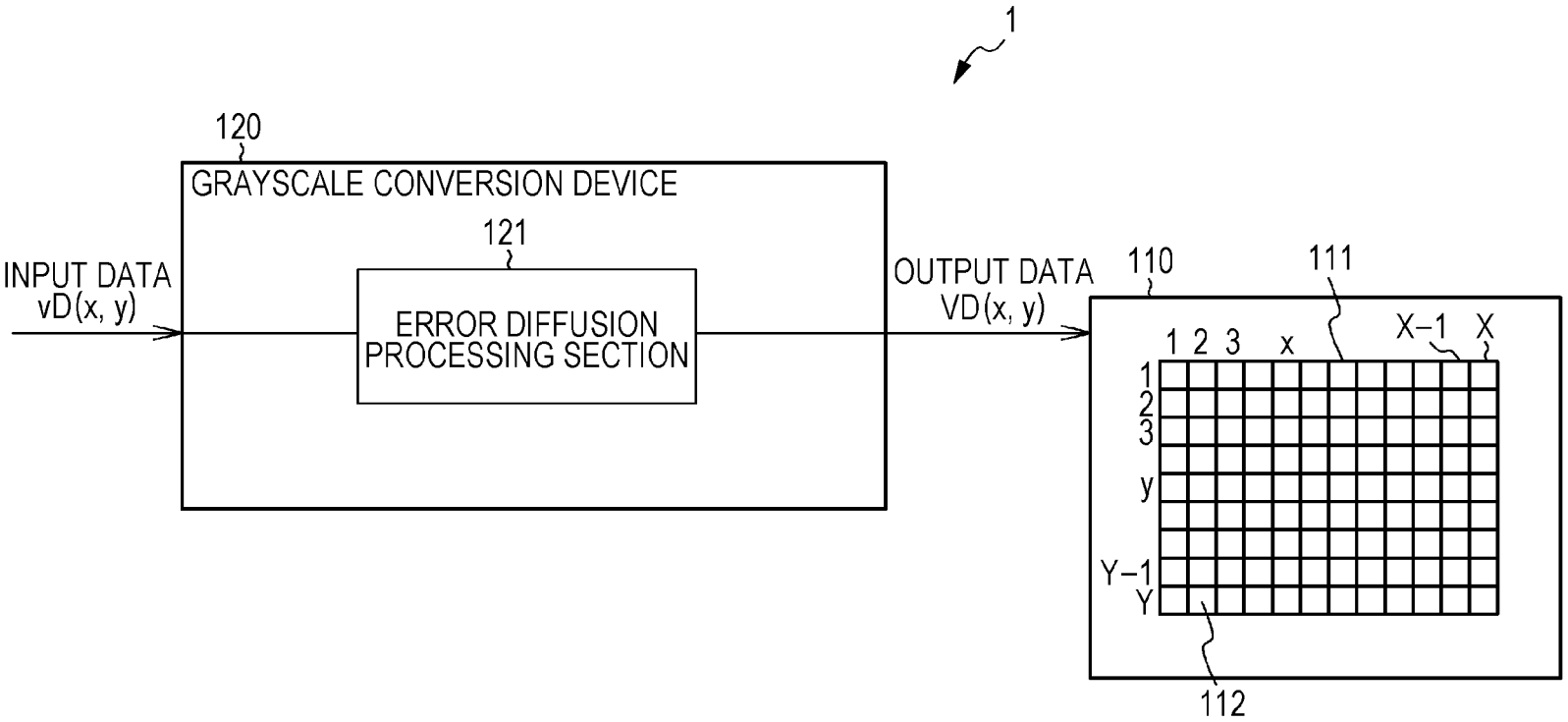
FIG. 1 is a conceptual diagram of an image display apparatus according to a first embodiment.

In the following, a description will be given of the present disclosure on the basis of embodiments with reference to the drawings. The present disclosure is not limited to the embodiments, and various numeric values and materials in the embodiments are examples. In the following description, the same reference letter is used for the same element or an element having the same function, and a duplicated description will be omitted. In this regard, the description will be given in the following order:

1. Description in General on Image Display Apparatus According to the Present Disclosure, Method of Driving Image Display Apparatus, Grayscale Conversion Program, and Grayscale Conversion Apparatus
2. First Embodiment (Others)

Description in General on Image Display Apparatus According to the Present Disclosure, Method of Driving Image Display Apparatus, Grayscale Conversion Program, and Grayscale Conversion Apparatus In an image display apparatus according to the present disclosure, a method of driving an image display apparatus, a grayscale conversion program, and a grayscale conversion apparatus, values of $N_0$ to $N_4$ grayscales ought to be suitably set in accordance with design and specification of the image display apparatus, etc. In a later description, a description will be given on the assumption that $N_0=256$, $N_1=10$, $N_2=2$, $N_3=3$, and $N_4=4$. However, these are only examples. Also, a "predetermined grayscale" value, which will be a reference to extract data to be a target of the second error diffusion processing and the third error diffusion processing ought to be suitably set in accordance with design and specification of the image display apparatus, etc.

In an image display apparatus according to the present disclosure, a configuration and a method of a display device that displays an image is not particularly limited. It is possible to use, as a display device, a widely publicized display device, such as a liquid-crystal display panel, an electroluminescence display panel, a plasma display panel, for example. Alternatively, it is possible to use, as a display device, a display medium, such as an electronic paper capable of being electrically rewritten. The display device may be a monochrome display or may be a color display.

It is possible to configure a grayscale conversion device included in an image display apparatus according to the present disclosure, a grayscale conversion device of the present disclosure, or a grayscale conversion apparatus on which an image display program according to the present disclosure is executed (hereinafter these are sometimes referred to simply as a grayscale conversion device of the present disclosure) by a calculation circuit and a storage device, for example. It is also possible to configure these using widely publicized circuit elements, etc.

The grayscale conversion may be conversion processing from a multi-valued image into a multi-valued image having a smaller number of grayscales, for example, conversion from 256-grayscale input data into 4-grayscale output data. In some case, the grayscale conversion may be conversion from a multi-valued image into a binary image, such as conversion from 256-grayscale input data into 2-grayscale output data, for example.

In an image display apparatus according to the present disclosure, a method of driving an image display apparatus, a grayscale conversion program, and a grayscale conversion apparatus, when on piece of input data corresponds to both lower grayscale data and higher grayscale data, it is possible to select higher grayscale data, and to generate output data.

In an image display apparatus according to the present disclosure including a preferable configuration described above, a method of driving an image display apparatus, a grayscale conversion program, and a grayscale conversion apparatus, it is possible for the grayscale conversion device to generate output data having been subjected to grayscale conversion for each of a plurality of kinds of input data associated with a corresponding one of a plurality of primary color displays. With this configuration, it is possible to perform preferable grayscale conversion processing in the case of a color display.

For pixel values, it is possible to exemplify some of image display resolutions, such as (1920, 1035), (720, 480), (1280, 960), and so on, in addition to VGA(640, 480), S-VGA(800, 600), XGA(1024, 768), APRC(1152, 900), S-XGA(1280, 1024), U-XGA(1600, 1200), HD-TV(1920, 1080), Q-XGA (2048, 1536). However, the present disclosure is not limited to these values.

A grayscale conversion program according to the present disclosure is executed in a grayscale conversion device so as to perform grayscale conversion processing on input data. For example, it is possible to employ a configuration in which the grayscale conversion program is stored in a storage means, such as a semiconductor memory, a magnetic disk, an optical disc, etc., and the above-described processing is executed in the grayscale conversion device.

First Embodiment

A first embodiment relates to an image display apparatus according to the present disclosure, a method of driving an image display apparatus, a grayscale conversion program, and a grayscale conversion apparatus.

FIG. 1 is a conceptual diagram of an image display apparatus according to the first embodiment.

An image display apparatus 1 according to the first embodiment includes a grayscale conversion device 120, which performs grayscale conversion processing on input data vD to output grayscale-converted output data VD, and a display device 110, which operates in response to the output data VD from the grayscale conversion device 120, and displays an image on pixels 112 arranged in a two-dimensional matrix state.

The display device 110 includes a liquid-crystal display panel of a monochrome display. In a display area 111 of the display device 110, X pieces of pixels are arranged in a horizontal direction (hereinafter sometimes referred to as a row direction), and Y pieces of pixels are arranged in a vertical direction (hereinafter sometimes referred to as a column direction), and thus X×Y pixels 112 in total are arranged in a two-dimensional matrix state. In the case of a transmissive display panel, light transmittance of the pixels 112 is controlled on the basis of values of the output data VD so that an amount of light transmission from a light source device not illustrated in FIG. 1, and thereby an image is displayed on the display device 110. In the case of a reflective display panel, light reflectance of the pixels 112 is controlled on the basis of values of the output data VD so that an amount of reflection of outside light is controlled, and thereby an image is displayed on the display device 110.

The grayscale conversion device 120 includes an error diffusion processing section 121, which performs grayscale conversion processing by an error diffusion method. The input data vD is inputted into the grayscale conversion device 120 correspondingly to each of the pixels 112. The error diffusion processing section 121 performs grayscale conversion, and outputs the output data VD.

The grayscale conversion device 120 operates on the basis of the grayscale conversion program stored in the storage means not illustrated in FIG. 1. The grayscale conversion device 120 performs first error diffusion processing for converting $N_0$-grayscale input data into $N_1$-grayscale data (note that $N_0$ and $N_1$ are integers that satisfy $2<N_1<N_0$). Next, the grayscale conversion device 120 performs second error diffusion processing for converting data having a predetermined grayscale or less out of the $N_1$-grayscale data into lower grayscale data having N2 grayscales (note that $N_2$ is an integer that satisfies $1<N_2<N_1$), and third error diffusion processing for converting data having the predetermined grayscale or more out of the $N_1$-grayscale data into higher grayscale data having N3 grayscales (note that $N_3$ is an integer that satisfies $1<N_3<N_1$). Then the grayscale conversion device 120 combines the lower grayscale data and the higher grayscale data to generate $N_4$-grayscale output data (note that $N_4$ is an integer that satisfies $1<N_4<N_1$). A detailed description will be given later on details of the operation with reference to FIG. 2 to FIG. 10.

The pixel 112 that is located at an x-th column (note that x=1, 2, . . . , X) and a y-th row (note that y=1, 2, . . . , Y) is represented by a (x, y)-th pixel 112 or a pixel 112 (x, y). The input data vD and the output data VD that are corresponding to the pixel 112 (x, y) are represented by input data vD(x, y) and output data VD(x, y), respectively.

The input data vD(1, 1) to vD(X, Y) are supplied to the grayscale conversion device 120 for each display frame. The grayscale conversion device 120 stores the input data vD(1,1) to vD(X,Y) for one display frame into the buffer not illustrated in FIG. 1, then performs grayscale conversion processing, and outputs the output data VD. In the following, a description will be given of grayscale conversion processing. Here, a description will be given of operation on the assumption that 256-grayscale input data is converted into 4-grayscale output data.

In this regard, here, 4-grayscale output data are set to four values, that is to say, 0, 155, 212, 255 in consideration of non-linearity of a gamma characteristic, etc., of the display device, but these values are only examples. If the display device has a linear characteristic, the output data basically ought to be set to four values at regular intervals.

Figure 2:
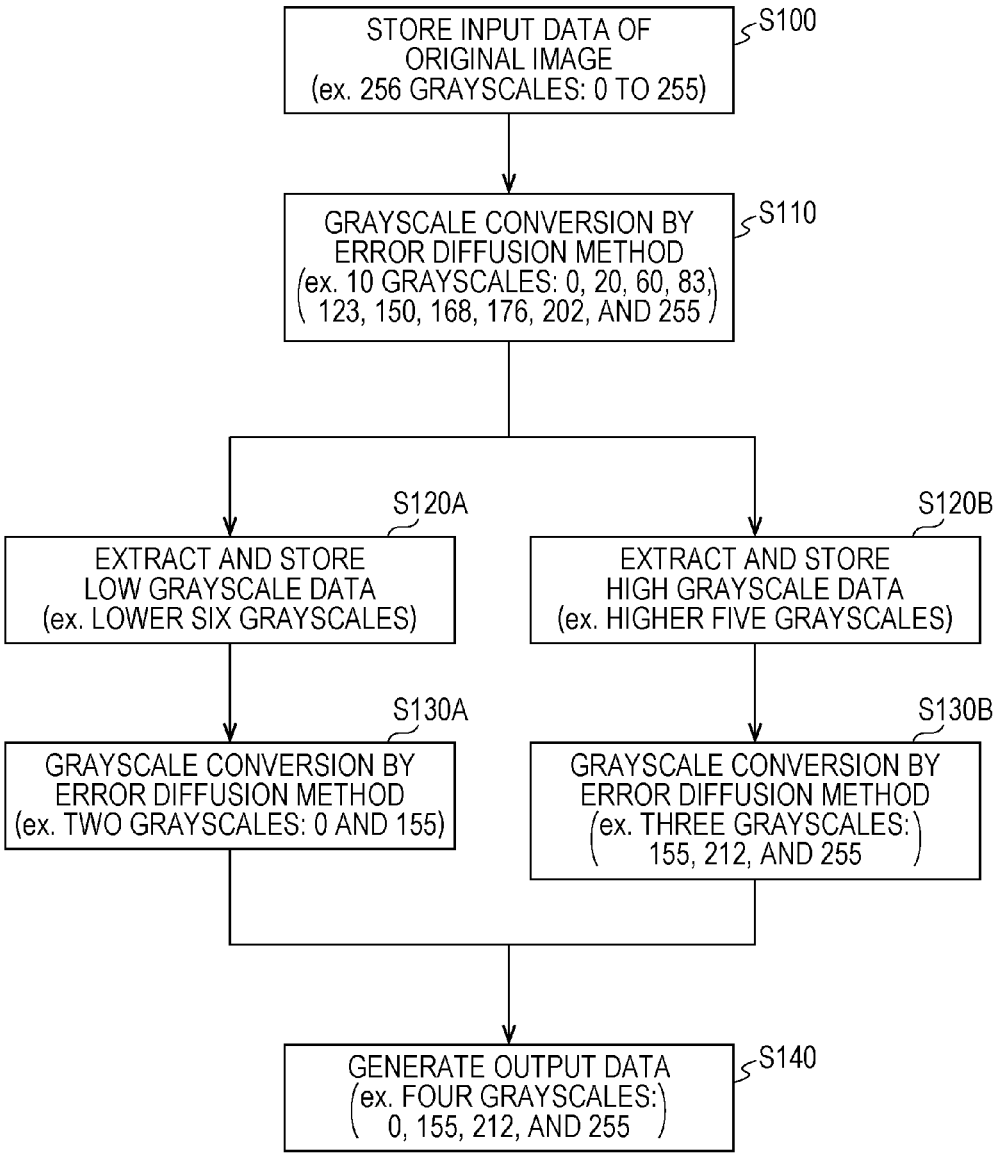
FIG. 2 is a flowchart for explaining processing in a grayscale conversion device.

FIG. 2 is a flowchart for explaining processing in the grayscale conversion device.

First, $N_0$(=256)-grayscale input data vD(1, 1) to vD(X, Y) is stored into a first buffer not illustrated in FIG. 1 (step [S100]).

FIG. 3 is a table for explaining input data values in step [S100] illustrated in FIG. 2. For convenience of illustration, values of X and Y are individually set to 16. In this regard, the values illustrated in FIG. 3 are only examples. These values are the same in FIG. 5 to FIG. 10 described later.

Next, the grayscale conversion device 120 performs the first error diffusion processing for converting $N_0$(=256)-grayscale input data into $N_1$-grayscale data (note that $N_0$ and $N_1$ are integers that satisfy $2<N_1<N_0$) (step [S110]). In the following, a description will be given on the assumption that $N_1$=10, and 10-grayscale data values are 0, 20, 60, 83, 123, 150, 168, 176, 202, and 255. In this regard, these values are only examples. In reality, preferable values ought to be selected and set by an experiment, etc.

Here, a description will be given of operation of the first error diffusion processing with reference to FIG. 4A to 4D.

FIG. 4A is a schematic plan view for explaining factors in error diffusion. FIG. 4B is a diagram illustrating weighting factor values in the case of a Floyd Steinberg type. FIG. 4C is a diagram illustrating weighting factor values in the case of a Sierra Filter lite type. FIG. 4D is a schematic plan view for explaining error diffusion operation.

As illustrated in FIG. 4A, in the first error diffusion processing, errors in the input data vD(x, y) are, in principle, diffused into input data vD(x+1, y) corresponding to a pixel on the right side, and input data vD(x−1, y+1), vD(x, y+1), and vD(x+1, y+1) corresponding to three pixels that are in a first line lower than the current pixel.

For example, assuming that vD(x, y)=224, 202≤vD(x, y)<255, and thus data after the grayscale conversion is determined to be 202. And an error, ER, is calculated by subtracting the data after the grayscale conversion from vD(x, y). In the example described above, the error: ER=224−202=22.

And the product of the error ER and a weighting factor "d" is added to the input data vD(x+1, y) corresponding to the right side pixel 112. Specifically, processing stating that "vD(x+1, y)+=d·ER" is performed. In this regard, "+=" is a substitution operator, and for example, "vD+=1" means "vD←vD+1". In this regard, in the case of x=X, there is no right side pixel 112, and thus the above-described processing is not performed.

In the same manner, the product of the error ER and a weighting factor "a" is added to the input data vD(x+1, y+1) corresponding to the lower right pixel 112. Specifically, processing of "vD(x+1, y+1)+=a·ER" is performed. In this regard, in the case of x=X or y=Y, there is no lower right pixel 112, and thus the above-described processing is not performed.

In the same manner, the product of the error ER and a weighting factor "b" is added to the input data vD(x, y+1) corresponding to the immediately lower pixel 112(x, y+1). Specifically, processing of "vD(x, y+1)+=b·ER" is performed. In this regard, in the case of y=Y, there is no immediately lower pixel 112, and thus the above-described processing is not performed.

In the same manner, the product of the error ER and a weighting factor "c" is added to the input data vD(x−1, y+1) corresponding to the lower left pixel 112(x−1, y+1). Specifically, processing of "vD(x−1, y+1)+=c·ER" is performed. In this regard, in the case of x=1 or y=Y, there is no lower left pixel 112, and thus the above-described processing is not performed.

In the following description, it is assumed that values of weighting factors "a, b, c, and d" are set as illustrated in FIG. 4B.

As illustrated in FIG. 4D, the error diffusion processing is first performed on input data vD(1, 1) corresponding to a pixel 112(1, 1) located at the upper left end, and after that, the grayscale conversion is performed on input data vD corresponding to a pixel 112 located at the right side in sequence. And when the grayscale conversion on input data vD(1, X) corresponding to the pixel 112(1, X) is completed, the grayscale conversion processing is performed on input data vD(1, 2) to 112(X, 2) corresponding to pixels 112(1, 2) to 112(X, 2) that are in one row lower than the current row in sequence. In the following, the same processing is performed, and the $N_0$(=256)-grayscale input data vD is converted into $N_1$(=10)-grayscale data.

FIG. 5 is a table for explaining grayscale-converted data values in step [S110] illustrated in FIG. 2.

Next, the grayscale conversion device 120 performs the second error diffusion processing for converting data having a predetermined grayscale or less out of the $N_1$(=10)-grayscale data into lower grayscale data having N2 grayscales (note that $N_2$ is an integer that satisfies $1<N_2<N_1$), and the third error diffusion processing for converting data having the predetermined grayscale or more out of the $N_1$-grayscale data into higher grayscale data having N3 grayscales (note that $N_3$ is an integer that satisfies $1<N_3<N_1$). Specifically, the grayscale conversion device 120 performs steps [S120A], [S130A], and steps [S120B],[S130B] illustrated in FIG. 2.

In this regard, in FIG. 2, step [S120A],[S130A], and step [S120B],[S130B] are displayed in parallel for the convenience of display. However, this is only an example. Although it depends on specification of the grayscale conversion device 120, it is possible to employ a configuration in which step [S120A],[S130A] are executed, and then step [S120B], [S130B] are executed. Alternatively, it is also possible to employ a configuration in which step [S120A],[S130A] and step [S120B],[S130B] are executed in parallel.

First, a description will be given of the second error diffusion processing targeted for data that having a predetermined grayscale or less out of the $N_1$(=10)-grayscale data. Here, a description will be given on the assumption that a predetermined grayscale is 150.

The grayscale conversion device 120 extracts data having a value of 150 or less out of the grayscale-converted data, and stores the data into the second buffer not illustrated in FIG. 1 (step [S120A]). At that time, the grayscale conversion device 120 stores a specific value indicating not targeted for the second error diffusion processing into parts of data having a value higher than 150 out of the grayscale-converted data.

FIG. 6 is a table for explaining low grayscale data values extracted in step [S120A] illustrated in FIG. 2. A position marked with a symbol "N/A" illustrated in FIG. 6 indicates that a specific value indicating not targeted for the second error diffusion processing is stored in that position.

The grayscale conversion device 120 converts the extracted low grayscale data into lower grayscale data having N2 grayscales. Here, it is assumed that $N_2$=2, and the lower grayscale data are two values, i.e., 0 and 155.

The grayscale conversion device 120 performs basically the same operation as that described with reference to FIG. 4 (step [S130A]). Note that the parts marked with the symbol "N/A" in FIG. 6 are not targeted for the second error diffusion processing, and thus both the grayscale conversion and the error diffusion are not performed.

FIG. 7 is a table for explaining grayscale-converted data values in step [S130A] illustrated in FIG. 2.

Next, a description will be given of the third error diffusion processing targeted for data having a predetermined grayscale or higher out of the $N_1$(=10)-grayscale data.

The grayscale conversion device 120 extracts data having a value of 150 or higher out of the grayscale-converted data, and stores the data into the third buffer not illustrated in FIG. 1 (step [S120B]). At that time, the grayscale conversion device 120 stores a specific value indicating not targeted for the third error diffusion processing into parts of data having a value lower than 150 out of the grayscale-converted data.

FIG. 8 is a table for explaining high grayscale data values extracted in step [S120B] illustrated in FIG. 2. A position marked with a symbol "N/A" illustrated in FIG. 8 indicates that a specific value indicating not targeted for the third error diffusion processing is stored in that position.

The grayscale conversion device 120 converts the extracted high grayscale data into higher grayscale data having N3 grayscales. Here, it is assumed that $N_3$=3, and the higher grayscale data are three values, i.e., 155, 212, and 255.

The grayscale conversion device 120 performs basically the same operation as that described with reference to FIG. 4 (step [S130B]). Note that the parts marked with the symbol "N/A" in FIG. 8 are not targeted for the third error diffusion processing, and thus both the grayscale conversion and the error diffusion are not performed.

FIG. 9 is a table for explaining grayscale-converted data values in step [S130B] illustrated in FIG. 2.

In the above, the descriptions have been given of the second error diffusion processing and the third error diffusion processing. The grayscale conversion device 120 combines the lower grayscale data and the higher grayscale data to generate $N_4$(=4)-grayscale output data.

Specifically, the grayscale conversion device 120 combines data other than the parts marked with "N/A" out of the lower grayscale data illustrated in FIG. 7 and data other than the parts marked with "N/A" out of the higher grayscale data illustrated in FIG. 9 to generate 4-grayscale output data. In this regard, when one piece of input data corresponds to both the lower grayscale data and the higher grayscale data, the grayscale conversion device 120 selects higher grayscale data for the pixel to generate output data.

FIG. 10 is a table for explaining output data values generated in step [S140] illustrated in FIG. 2.

As described above, the grayscale conversion processing on the input data is performed in combination of a result of the second error diffusion processing and a result of the third error diffusion processing on the data that have been subjected to first error diffusion processing. To put it in another way, error diffusion processing is performed for a plurality of times with different conditions, and thereby grayscale conversion processing is performed. Accordingly, grayscale discontinuity is reduced when processing is performed on an image having gentle gradation.

Figure 11A:
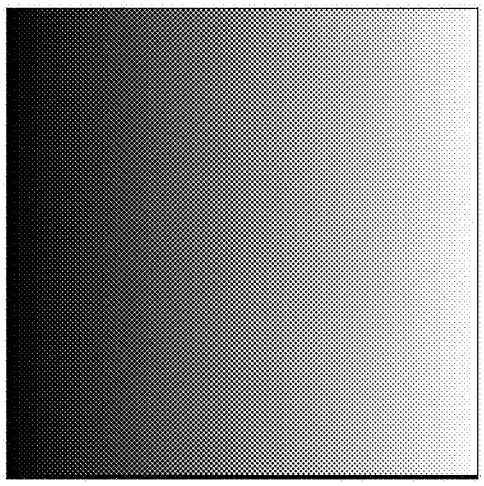
FIG. 11A illustrates an example of a 256-grayscale image having 0 to 255 grayscale values.
Figure 11B:
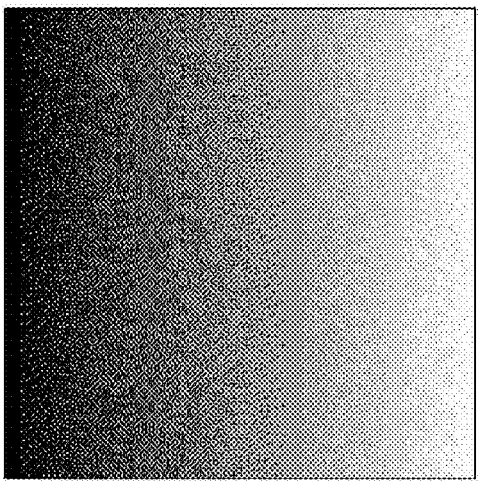
FIG. 11B illustrates an image converted from an image illustrated in FIG. 11A into a 4-grayscale image, for example, 0, 155, 212, and 255 grayscale values, by a normal error diffusion method.

FIG. 11A illustrates an example of a 256-grayscale image having 0 to 255 grayscales. Also, as a reference example, FIG. 11B illustrates an image converted from the image illustrated in FIG. 11A into a 4-grayscale image, for example, 0, 155, 212, and 255 grayscales, by an error diffusion method.

Figure 11C:
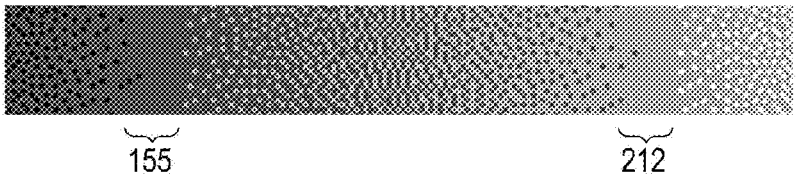
FIG. 11C is a schematic plan view for explaining a phenomenon in which grayscale values look discontinuous in the vicinity of 155 or 212 at the time of data processing.

In the case of processing an image having a gentle gradation as in FIG. 11A, in processing data in the vicinity of a grayscale value of 155 or 212, errors diffused in neighboring pixels become relatively small. Accordingly, for the pixels in the vicinity of these grayscales, gradation expression by error diffusion is not sufficiently given, and a phenomenon in which grayscale appears discontinuous occurs as illustrated in FIG. 11C.

Figure 12A:
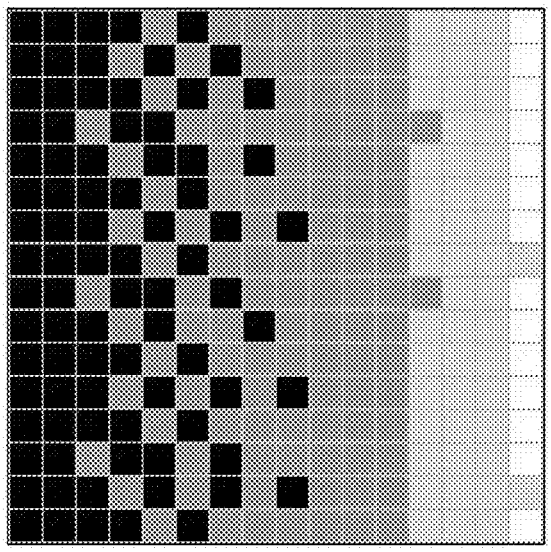
FIG. 12A illustrates an image when an image having 16×16=256 grayscales is converted into a 4-grayscale image by a normal error diffusion method.
Figure 12B:
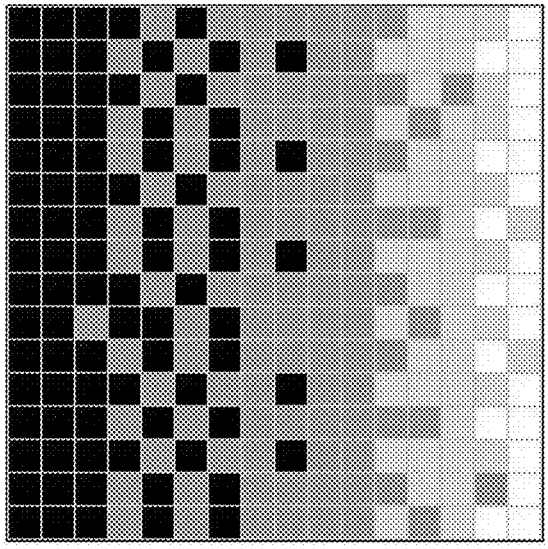
FIG. 12B illustrates an image when an image having 16×16=256 grayscales is converted into a 4-grayscale image by a first embodiment.

FIG. 12A illustrates an image when an image having 16×16=256 grayscales is converted into a 4-grayscale image by a normal error diffusion method. FIG. 12B illustrates an image when an image having 16×16=256 grayscales is converted into a 4-grayscale image by a first embodiment.

As is apparent from these figures, by the first embodiment, grayscale discontinuity is reduced when processing is performed on an image having gentle gradation.

In the above-described example, a description has been given that errors are diffused into a pixel 112 located immediately after the current pixel and three pixels located in a first line lower than the current pixel, that is to say, four pixels in total at the time of the error diffusion. However, error diffusion is not limited to this. For example, as illustrated in FIGS. 13A and 13B, errors may be diffused into two pixels located immediately after the current pixel and five pixels located in a first line lower than the current pixel, and pixels located in a second line lower than the current pixel, and thus 12 pixels in total. Alternatively, as illustrated in FIG. 13C, errors may be diffused into two pixels located immediately after the current pixel and five pixels in a first line lower than the current pixel, that is to say, seven pixels in total. In this regard, values of weighting factors illustrated in FIGS. 13A to 13C, are examples, and it is possible to suitably set the weighting factors in accordance with design of the image display apparatus.

Also, in the above description, it is assumed that the display device 110 is a monochrome display. However, it is possible to employ a color display. In this case, the grayscale conversion device generates output data having been subjected to grayscale conversion for each of a plurality of kinds of input data associated with a corresponding one of a plurality of primary color displays.

Figure 14:
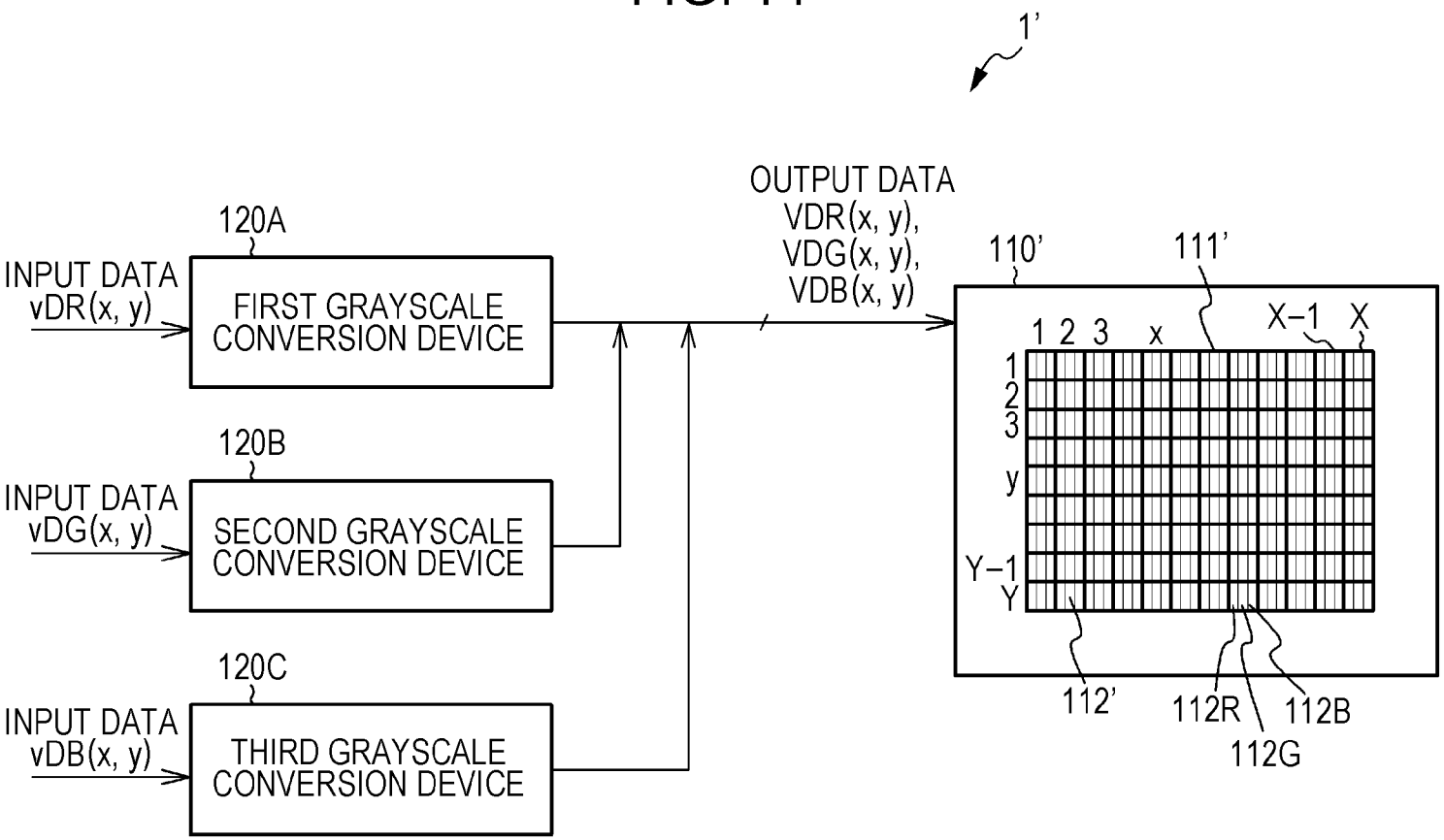
FIG. 14 is a conceptual diagram of an image display apparatus in a case where a display device is a color display.

FIG. 14 is a conceptual diagram of an image display apparatus in the case where a display device is a color display.

The image display apparatus 1' includes a first grayscale conversion device 120A, a second grayscale conversion device 120B, and a third grayscale conversion device 120C. These have the same configuration as that of the grayscale conversion device 120 illustrated in FIG. 1. A pixel 112' included in a pixel display device 110' is formed by groups of a red light emitting subpixel 112R, a green light emitting subpixel 112G, and a blue light emitting subpixel 112B. The pixels 112' are arranged in a two-dimensional state in a display area 111'. The first 1 grayscale conversion device 120A performs the same operation on red-color display input data vDR(x, y) as that of the above description. The second grayscale conversion device 120B performs the same operation on green-color display input data vDG(x, y) as that of the above description. The third grayscale conversion device 120C performs the same operation on blue-color display input data vDB(x, y) as that of the above description. And a grayscale-converted image is displayed on the display device 110' on the basis of the output data VDR(x, y), VDG(x, y), and VDB(x, y). In this regard, a description has been given of a configuration in which a pixel includes three color sub-pixels. However, this is only an example. It is possible to employ a configuration in which a pixel further includes sub-pixels of the other light-emitting colors.

In the above, specific descriptions have been given of embodiments according to this disclosure. However, the present disclosure is not limited to the above-described embodiments. It is possible to make various variations on the basis of the spirit and scope to this disclosure.

In this regard, a technique according to the present disclosure can also be configured as follows.

(1) An image display apparatus including:

a grayscale conversion device configured to perform grayscale conversion processing on input data and to output grayscale-converted output data; and a display device configured to operate in accordance with the output data from the grayscale conversion device and to display an image by pixels arranged in a two-dimensional matrix state, wherein the grayscale conversion device is configured to perform first error diffusion processing for converting $N_0$-grayscale input data into $N_1$-grayscale data (note that $N_0$ and $N_1$ are integers that satisfy $2<N_1<N_0$), next, to perform second error diffusion processing for converting data having a predetermined grayscale or less out of the $N_1$-grayscale data into lower grayscale data having N2 grayscales (note that $N_2$ is an integer that satisfies $1<N_2<N_1$), to perform third error diffusion processing for converting data having the predetermined grayscale or more out of the $N_1$-grayscale data into higher grayscale data having N3 grayscales (note that $N_3$ is an integer that satisfies $1<N_3<N_1$), and then to combine the lower grayscale data and the higher grayscale data to generate $N_4$-grayscale output data (note that $N_4$ is an integer that satisfies $1<N_4<N_1$).

(2) The image display apparatus according to (1), wherein when one piece of input data corresponds to both lower grayscale data and higher grayscale data, the grayscale conversion device is configured to select the higher grayscale data, and to generate output data.

(3) The image display apparatus according to (1) or (2), wherein the grayscale conversion device is configured to generate output data having been subjected to grayscale conversion for each of a plurality of kinds of input data associated with a corresponding one of a plurality of primary color displays.

(4) A method of driving an image display apparatus including a grayscale conversion device configured to perform grayscale conversion processing on input data and to output grayscale-converted output data, and a display device configured to operate in accordance with the output data from the grayscale conversion device and to display an image by pixels arranged in a two-dimensional matrix state, the method causes the grayscale conversion device to perform processing including:

performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$); and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

(5) A grayscale conversion program executed on a grayscale conversion device configured to perform grayscale conversion processing on input data and to output grayscale-converted output data, the grayscale conversion program performs processing including:

performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$) and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

(6) A grayscale conversion apparatus including a grayscale conversion device configured to perform grayscale conversion processing on input data and to output grayscale-converted output data, the grayscale conversion processing including:

performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$); and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image display apparatus comprising:

a grayscale conversion device configured to perform grayscale conversion processing on input data and to output grayscale-converted output data; and a display device configured to operate in accordance with the output data from the grayscale conversion device and to display an image by pixels arranged in a two-dimensional matrix state, wherein the grayscale conversion device is configured to perform first error diffusion processing for converting $N_0$-grayscale input data into $N_1$-grayscale data (note that $N_0$ and $N_1$ are integers that satisfy $2<N_1<N_0$), next, to perform second error diffusion processing for converting data having a predetermined grayscale or less out of the $N_1$-grayscale data into lower grayscale data having N2 grayscales (note that $N_2$ is an integer that satisfies $1<N_2<N_1$), to perform third error diffusion processing for converting data having the predetermined grayscale or more out of the $N_1$-grayscale data into higher grayscale data having N3 grayscales (note that $N_3$ is an integer that satisfies $1<N_3<N_1$), and then to combine the lower grayscale data and the higher grayscale data to generate $N_4$-grayscale output data (note that $N_4$ is an integer that satisfies $1<N_4<N_1$).

2. The image display apparatus according to claim 1, wherein when one piece of input data corresponds to both lower grayscale data and higher grayscale data, the grayscale conversion device is configured to select the higher grayscale data, and to generate output data.

3. The image display apparatus according to claim 1, wherein the grayscale conversion device is configured to generate output data having been subjected to grayscale conversion for each of a plurality of kinds of input data associated with a corresponding one of a plurality of primary color displays.

4. A method of driving an image display apparatus including a grayscale conversion device configured to perform grayscale conversion processing on input data and to output grayscale-converted output data, and a display device configured to operate in accordance with the output data from the grayscale conversion device and to display an image by pixels arranged in a two-dimensional matrix state, the method causes the grayscale conversion device to perform processing comprising:

performing first error diffusion processing for converting $N_0$-grayscale input data into $N_1$-grayscale data (note that $N_1$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$); and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

5. A grayscale conversion program executed on a grayscale conversion device configured to perform grayscale conversion processing on input data and to output grayscale-converted output data, the grayscale conversion program performs processing comprising:

performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$) and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

6. A grayscale conversion apparatus including a grayscale conversion device configured to perform grayscale conversion processing on input data and to output grayscale-converted output data, the grayscale conversion processing comprising:

performing first error diffusion processing for converting $N_0$-grayscale input data into $N_1$-grayscale data (note that $N_0$ and N1 are integers that satisfy $2<N_1<N_0$); next, performing second error diffusion processing for converting data having a predetermined grayscale or less out of the $N_1$-grayscale data into lower grayscale data having N2 grayscales (note that $N_2$ is an integer that satisfies $1<N_2<N_1$); and performing third error diffusion processing for converting data having the predetermined grayscale or more out of the $N_1$-grayscale data into higher grayscale data having N3 grayscales (note that $N_3$ is an integer that satisfies $1<N_3<N_1$); and then combining the lower grayscale data and the higher grayscale data to generate $N_4$-grayscale output data (note that $N_4$ is an integer that satisfies $1<N_4<N_1$).

* * * * *